US005330797A

United States Patent [19]

Muës

[11] Patent Number: 5,330,797

[45] Date of Patent: Jul. 19, 1994

[54] CURTAIN COATER WITH DISPLACEABLE EDGE GUIDES AND METHOD

[75] Inventor: Willem Muës, Tremelo, Belgium

[73] Assignee: Agfa-Gevaert N. V., Mortsel, Belgium

[21] Appl. No.: 895,692

[22] Filed: Jun. 9, 1992

[30] Foreign Application Priority Data

Jun. 18, 1991 [EP] European Pat. Off. ... EP 91201538.5

[51] Int. Cl.[5] ..... B05D 1/30; B05C 5/00

[52] U.S. Cl. ..... 427/420; 118/324; 118/DIG. 4

[58] Field of Search ..... 427/420; 118/DIG. 4, 118/324, 300

[56] References Cited

U.S. PATENT DOCUMENTS 4,479,987 10/1984 Koepke et al. ..... 118/DIG. 4
4,647,482 3/1987 Degrauwe et al. ..... 118/DIG. 4
4,922,851 5/1990 Morikawa et al. ..... 427/420

*Primary Examiner*—Shrive Beck
*Assistant Examiner*—Katherine A. Bareford
*Attorney, Agent, or Firm*—William J. Daniel

[57] ABSTRACT

A curtain coater and coating method for coating a moving web with at least one layer of a liquid coating composition utilizes a web-supporting roller for conveying the web along a path, a coating hopper for forming a free falling generally planar curtain of the coating composition which extends transversely of the web and impinges upon the web at a point on the path where the web is supported on the roller, edge guides on opposite sides of the web path for laterally guiding the falling curtain by contact with the curtain side edges, and a curtain intercepting member is occasionally displaceable from an inoperative position out of the path of the falling curtain to an intercepting position adjacent the web for intercepting the falling curtain, wherein the intercepting member has a dimension transversely of the web that is greater that the transverse dimension of the web itself and a portion of each of the edge guides adjacent to the web is displaceable independently of the coating hopper away from the web to a position removed from the web, preferably out of the plane of the falling curtain, and out of the way of the intercepting member to allow the intercepting member to take its intercepting position, and when the intercepting member is moved to inoperative position, each edge guide portion is returned to its position adjacent the web.

9 Claims, 5 Drawing Sheets

CURTAIN COATER WITH DISPLACEABLE EDGE GUIDES AND METHOD

BACKGROUND OF THE INVENTION

1. Field of the Invention

The present invention relates to a curtain coater for coating a layer of liquid coating compositions on a moving continuous web in the manufacture of a photographic element.

2. Description of the Prior Art

In coating apparatus of the curtain type, a moving web is coated by causing a free falling vertical curtain of coating liquid to impinge onto the moving web to form a layer on said web. An apparatus is described in U.S. Pat. No. 3,508,947 wherein a multilayer composite of a plurality of distinct layers is formed on a slide hopper and caused to impinge onto an object or moving web to form a coated layer thereon.

In the curtain coating process, particularly as used to manufacture multilayer photographic materials, the quality of coating is largely determined by the properties of the liquid curtain. It is important to insure that a stable laminar flow of liquid film is formed by the slide hopper and that an equally stable, laminar flow liquid curtain is formed from that film. To prevent contraction of the falling curtain under the effect of surface tension, it is known that the curtain must be guided at its edges by curtain edge guides.

The edge guides are solid members which are attached to the hopper used to supply coating liquid to the curtain and extend downwardly from the initial point of free fall of the curtain. Wetting contact of the edges of the falling curtain with the edge guides should be maintained over the entire length of the guides to avoid a contraction of the curtain.

These edge guides give rise to some problems. The wetting contact of the edges of the curtain with the guides causes non-uniformities of the coating if the full width of the curtain is applied to the moving web. By making the curtain wider than the web to be coated by an amount at least equal to this non-uniform region at each edge, a substantially uniform coating can be formed on the web. The coating liquid at the margins of the curtain that overflows the edges of the travelling web can be collected. However there is a serious risk of the coating, which is wetting those edges, to run onto the reverse margin of the web. This can cause soiling of the web transporting rollers of the web gelling and drying stations so that the production process must be interrupted to clean the rollers. Therefore, the distance between the two edge guides is preferably smaller than the width of the web.

In order to avoid the problem of the non-uniformities of the coating at the edges a lot of methods and devices are disclosed in e.g. U.S. Pat. No. 3,508,947, EP 0,176,632 and U.S. Pat. No. 4,830,887. All these techniques require the lower end of the edge guides be positioned as close as possible to, or even making contact with, the web.

It is very important for a curtain coater to uniformly apply a freely falling curtain of a liquid to a moving web at the start of the coating. If the liquid is not uniformly applied to the moving web at the start of the operation, problems such as contamination due to spattering of the applied liquid and contamination of a roller due to non-drying of greater thickness portions of the applied liquid downstream to a drying zone can occur, making the final product unacceptable. Therefore for a modern production process, it is of great importance to reduce these startlosses to a minimum.

In the curtain coater disclosed in the U.S. Pat. No. 3,508,947 an intercepting start plate, which is a turnable or slidable deflector, is provided which deflects a quantity of the liquid at the start of the coating in order to enable an operator to take measures for the formation of a uniform and stable curtain. The deflected coating liquid may be recovered. EP 0 344 745 A1 describes another embodiment of the same technique; a turnable start plate has a fulcrum under the backup roller.

When the lower end of the edge guides has to be postioned as close as possible to the web, there is simply no space left for a start plate to be positioned between edge guides and web. It is not practically possible to use a start plate that is smaller than the distance between the two edge guides, since it will not gather all the liquid and the remaining will soil inevitably the web in a non-uniform way. A solution known in the art is to move the entire coating device together with the edge guides and interceptors or other means to avoid coating thick edges, as described in the patents mentioned before, to an upward position, in order to allow a start plate to be positioned underneath. When a uniform and stable liquid curtain has been established, the start plate can be removed and the coating device is lowered in operation position. This operation is mechanically difficult to execute and time consuming. During this operation the curtain will contract due to the fact that the edge guides are not close enough to the web. The coated web produced during this operation is therefore not suited for the desired application.

SUMMARY OF THE INVENTION

Objects of the Invention

It is an object of the present invention to provide a curtain coater that facilitates the start of a coating operation in the manufacture of photographic elements. It is a further object to provide a method for controlling the start of curtain coating. Other objects will become apparent from the description hereinafter.

Statement of the Invention

According to the present invention, a curtain coater for coating a web with at least one layer of a liquid coating composition or a plurality of superposed layers forming one composite layer, comprising a web-supporting roller for conveying the web, a hopper for forming a free-falling curtain of the liquid coating composition which extends transversely of the web at a position where the web is supported on the web-supporting roller, edge guides for laterally guiding the falling curtain, and a displaceble curtain interceptor for occasionally intercepting the falling curtain, is characterised in that the interceptor has a width larger than the distance between the edge guides, and that at least a part of the edge guides is displaceble in order to enable the interceptor to take its intercepting position.

The edge guides can comprise an upper, stationary section and a lower displaceble section. The displaceble section of the guides can be pivoted for swinging movement about an axis parallel to the axis of the web-supporting roller. In order to improve the guiding of the edges of the curtain, an auxiliary liquid can keep the edge of the curtain in strong adherent contact with the edge guides. Means for reducing thick edge portions can be connected as well to these edge guides.

The present invention includes also a method for controlling the start of curtain coating. In accordance with the invention, a method of controlling the start of curtain coating in which edge guides are in adherent contact with the curtain edges, by intercepting the curtain before it impinges on a web to be coated until a uniform coating curtain has been established, and next terminating the interception to start the coating, is characterised by at least partly interrupting the edge guiding of the curtain and carrying out the interception of the curtain over its full width at the location of such interruption, and immediately restoring the normal edge guiding of the curtain edges as the interception of the curtain becomes terminated.

BRIEF DESCRIPTION OF THE DRAWINGS

The invention is described hereinafter by way of example with reference to the accompanying drawings, wherein.

DETAILED DESCRIPTION OF THE DRAWINGS

Figure 1:
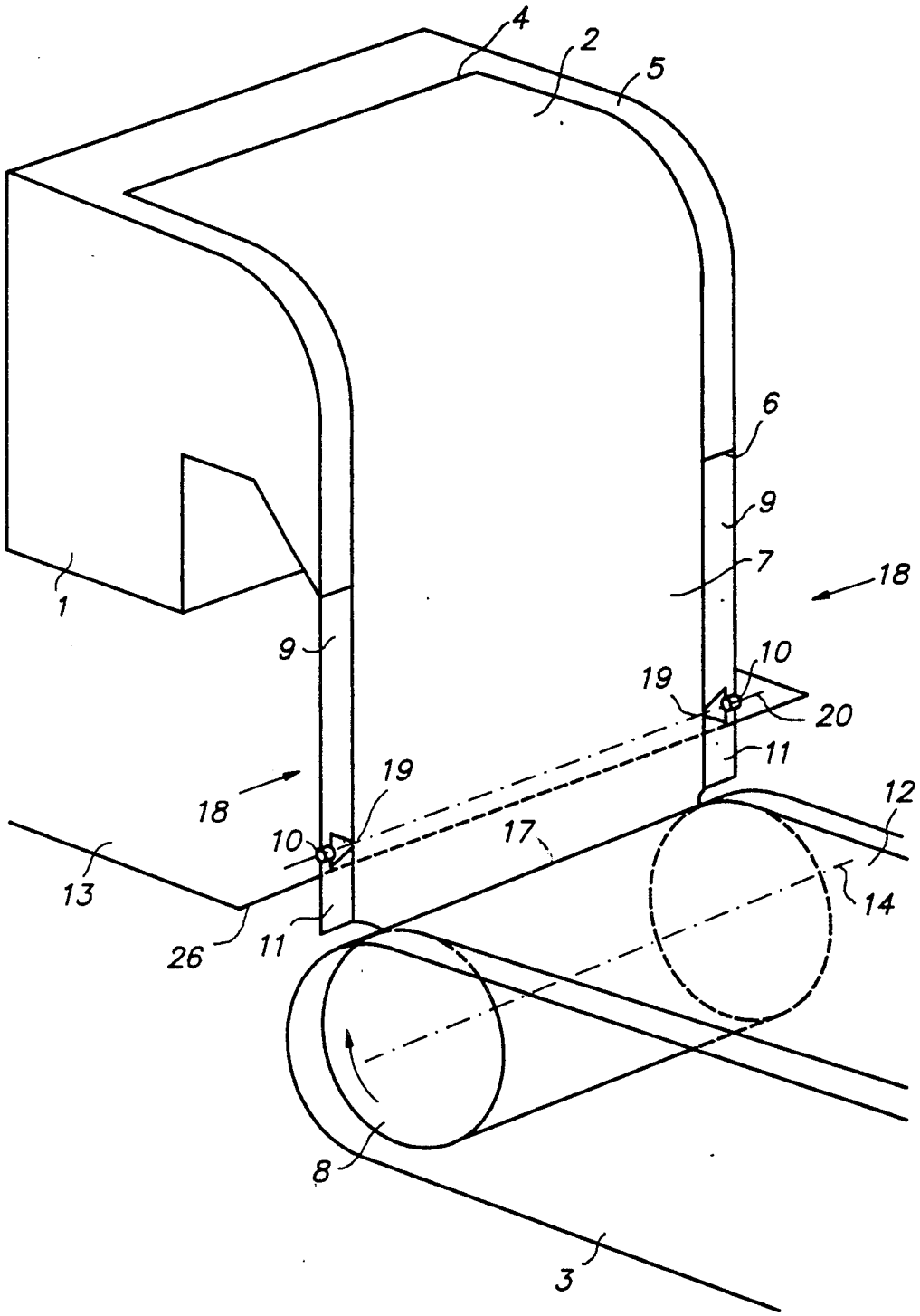
FIG. 1 shows one embodiment of a curtain coater in operation.

Referring to FIG. 1 a coater is illustrated comprising a coating head 1 of the slide-hopper type that is arranged for applying a layer of liquid coating composition 2 to a moving web 3 by curtain coating. The hopper is supplied with coating composition through a manifold (not illustrated) and has an elongate discharge slot 4 from which the coating composition flows over a slide surface 5 unto a lip 6 from which it falls freely downwardly in the form of a curtain 7. The hopper extends transversely the path of travel of a web 3 to be coated, the path being determined by a backing roller 8.

Means is provided, not illustrated, for controlling the correct web speed, the lateral postion, and the web tension.

Edge guides 18 are provided near both lateral ends of lip 6 that are in adherent contact with the edges of the free-falling curtain 7 and thereby keep the curtain stretched in the transverse direction until it contacts the web 3 on a transverse line 17, the coating line. The edge guides have an upper, stationary section 9, a hinge 10 and a lower displaceble, pivotable in this case, section 11. In the operative position, the upper 9 and the lower section 11 of the edge guides are in contact with the curtain and form a straight line. Due to construction reasons a small gap 19 between the upper 9 and lower 11 section has to be taken into account. This gap has to be smaller than approximately 1 mm, otherwise the curtain will not make properly contact with the lower edge section 11 of the guides 18 and will contract due to surface tension. It is surprising that the curtain 7 can bridge this gap 19 without giving rise to any disturbance.

Afterwards the coating is subjected to controlled temperatures and humidities to effect setting and drying of the coated layers (not illustrated).

Figure 2:
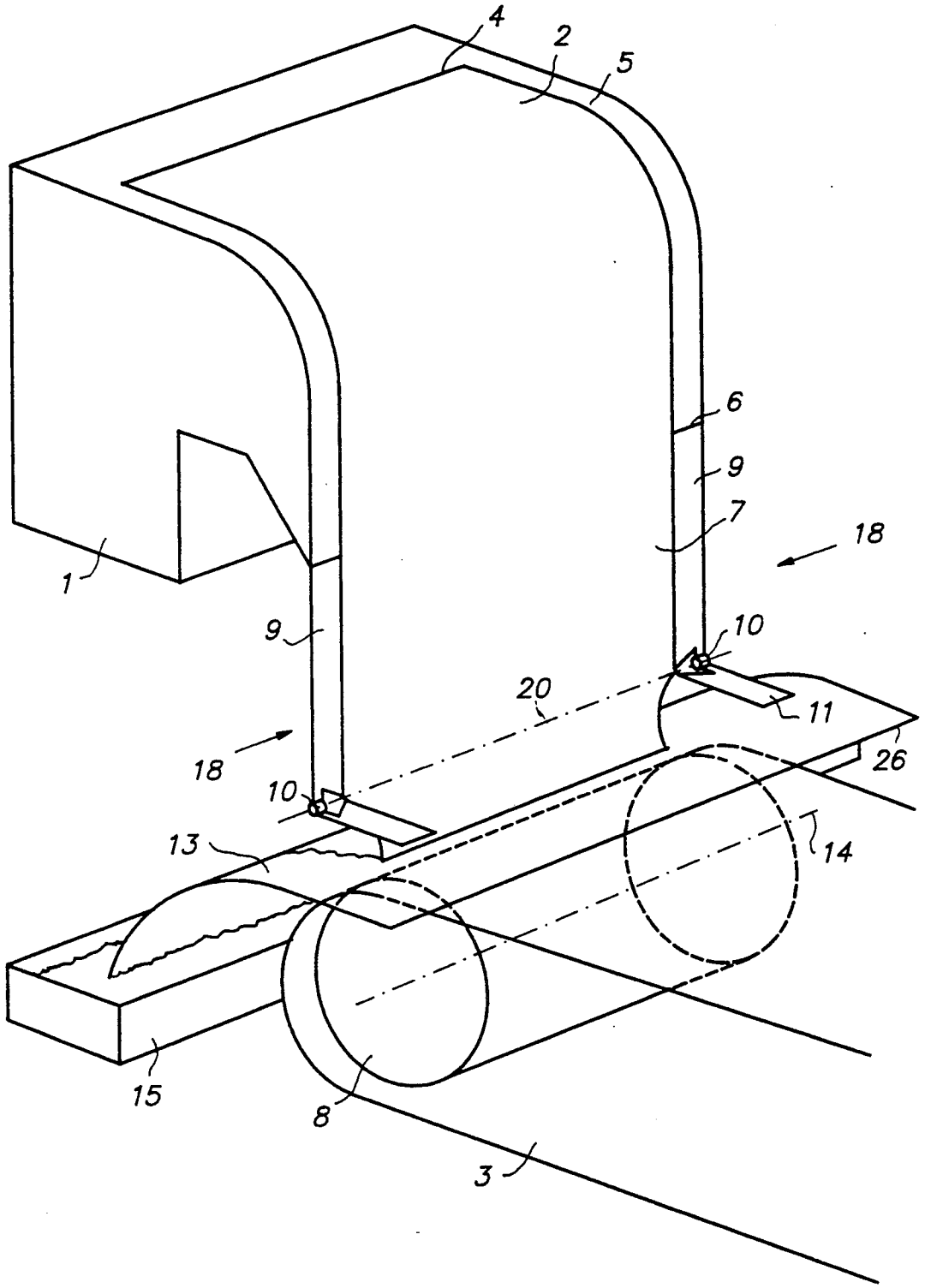
FIG. 2 shows the curtain coater of FIG. 1 but in a non-operative position.

FIG. 2 is a view of the curtain coater in the non-operative position. At the beginning of the coating procedure a stable and uniform curtain has to be obtained. During this period a displaceble interceptor 13 intercepts the entire curtain 7 and evacuates the liquid coating compostion into a tray, such as tray 15. In order to enable the interceptor 13 to take its intercepting position, at least the lower part of the edge guides 18 has to be displaced. Hinges 10 allow the lower section 11 of the edge guides 18 to be pivoted around an axis 20. The axis runs parallel with the axis 14 of the web-supporting roller 8. At the end of the non-operative period the interceptor 13 slides or pivots from underneath the curtain 7, the curtain impinging now on the moving web 3, and the displacable sections 11 of the edge guides 18 return to their vertical positions, guiding the curtain over its full length. The coater is in a operative postition and is able to coat the surface of the web 3 in a uniform way.

Interceptor 13 can be made out of a strong flexible light-weight material, such as plastic or a poyester foil, the leading end 26 being strengthenend by a sharp metallic knife. EP 0 344 745 describes other possible geometries for the leading end 26 of this interceptor 13, it describes also the importance of the geometry of this leading end 26.

Figure 3:
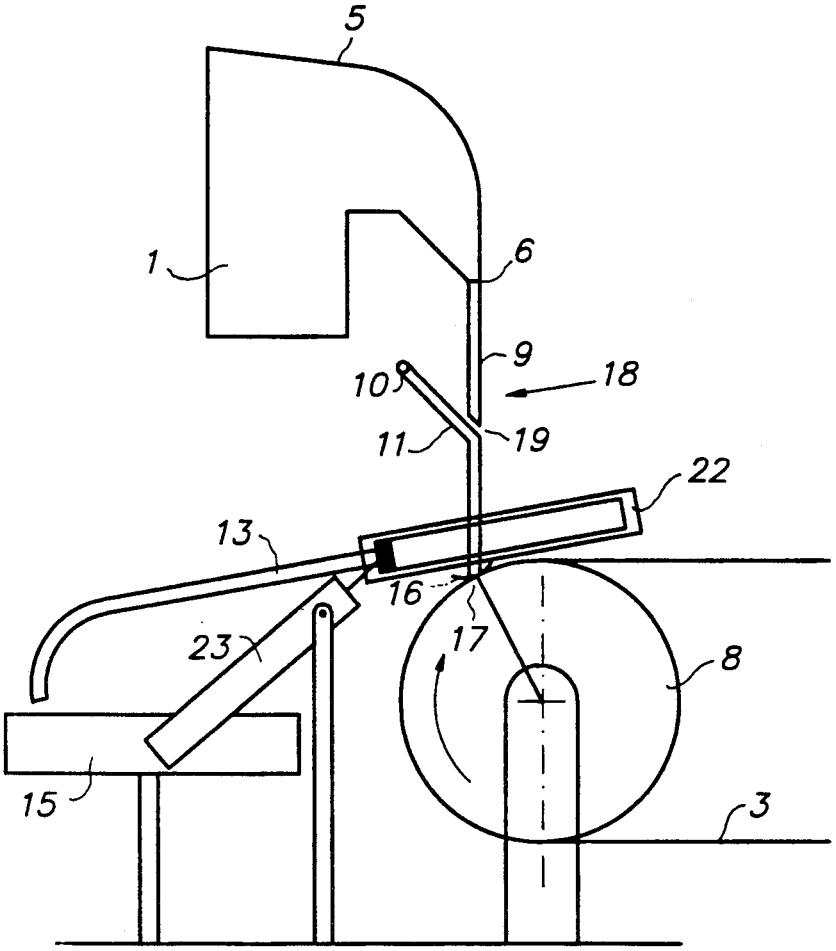
FIG. 3 shows a lateral view of a preferred embodiment of a curtain coater in operation.
Figure 4:
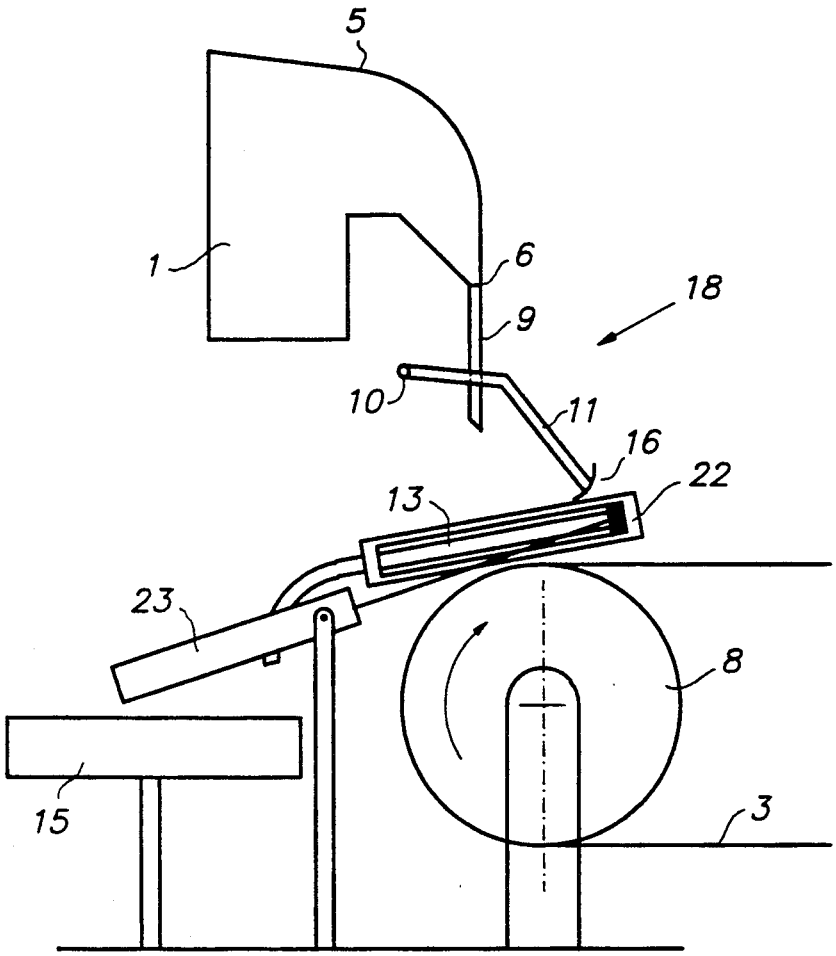
FIG. 4 shows the curtain coater of FIG. 3 but in a non-operative position.
Figure 5:
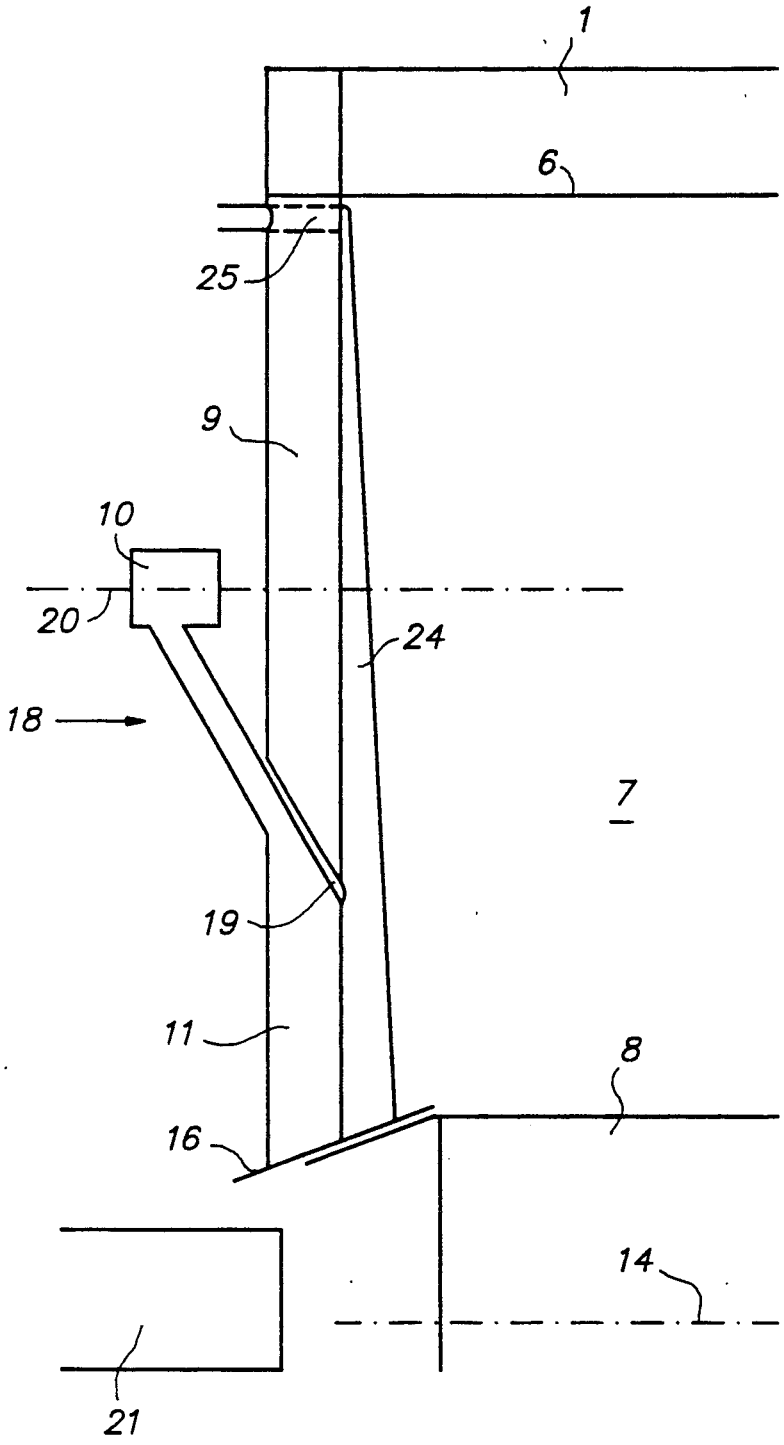
FIG. 5 is a detailed front view of a preferred embodiment of an edge guide of a curtain coater in operation.

FIGS. 3, 4 and 5 are views of a preferred embodiment of a curtain coater. A coating operation starts with a curtain coater in a non-operative position as in FIG. 4. The stationary section 9 of the edge guides 18 is connected with the lateral ends of a lip 6 of a hopper 1. The connection can be made in a fixed way, although it is preferable to construct this connection in such a way that it can be broken quite easily. A magnetic or adhesive connection that can be broken by a simple mechanical force allows the edge guides 18 or at least the stationary sections 9 to be thrown away when anything should hit the edge guide 18. For instance, if the web tears lateraly, the loose ends can dammage the edge guide and/or the coater if they are strongly fixed to the hopperlip 6.

The lower displaceble section 11 of the edge guide 18 is pivoted in a forward position around a hinge 10. The swinging occurs in a plane normal to the axis of the web-supporting roller 8. The lower section 11 of the edge guide 18 is displaced in order to allow a curtain interceptor 13 to be positioned underneath the upper section 9 of the edge guide 18 and beyond the coating line 17, this is the line where a free falling liquid curtain should hit the web 8 for the first time. Two elongated lateral guides 22, placed at both lateral ends, allow the curtain interceptor 13 to glide from a intercepting position (FIG. 4) towards a non-intercepting postion (FIG. 3). In this embodiment the movement is produced with a pneumatic system 23. Other mechanical means can be used to perform the same operation.

The start procedure begins by supplying the hopper i with a coating compostion through a manifold (not illustrated). The coating composition flows over the slide surface 5 unto the lip 6 from which it falls freely downwardly on the curtain interceptor 13, and into a catch tray 15. The operator tries to form a uniform layer or a plurality of superimposed layers constituting one composite layer on the slide surface 5. This may be done in a rather pragmatic way, based on the experience of the operator. The uniform layer(s) have to form a curtain which extends form one edge guide towards the other, therefore the operator uses his hands and/or a little stick to stretch the curtain and to bring it in contact with the edge guide. As described in EP 0 115 621 and schematicly shown in FIG. 5 an auxiliary liquid 24 provided between the edge guides 18 and the curtain 7 ameliorates the stability of the contact between the curtain 7 and the guide 18. The auxiliary liquid is supplied through a discharge opening 25 in section 9 of edge guide 18.

If these actions are properly taken a uniform curtain 7 leaves the upper secton 9 of the guides at the lowest tip, contracts due to surface tension and falls down on the interceptor 13. The liquid is evacuated through a catch tray 15. The operator can now start the automatic start sequence. This sequence is performed by the process-control devices (not illustrated).

A controller gives a signal to the pneumatic system 23 which pulls the curtain interceptor 13 in its non-intercepting position guided by the elongate lateral guides 22. Within the same second the lower section 11 of the edge guide 18 is pivotted back in its vertical position whereby the edge of this lower section 11 that will make contact with the curtain forms a straight line with the corresponding edge of the upper section 9 of the edge guide. This swinging is also performed by a pneumatical system (not illustrated) and initiated by the controller. The curtain 7 and the auxiliary liquid 24 immediately narrows the gap 19 between the upper section 9 and the lower section 11 of the edge guide 18. The curtain 7 falls now on the moving web 3, producing a photographic element.

In EP 0 176 632 an edge interceptor is described allowing to coat uniformly while leaving marginal portions of the web uncoated. This feature solves the problem of non-uniformities of the coating at edges, or the problem of thick edge portions, if the full width of the curtain is applied to the moving web. FIG. 5 shows an edge interceptor 16 as described in said European Patent specification which is connected to the lower section 11 of the edge guide 18. An edge catch tray 21 collects a small amount of the curtain liquid together with the auxiliary liquid 24. It is also possible to connect other means for reducing thick edge portions, such as described in U.S. Pat. No. 4,830,887 or U.S. Pat. No. 3,508,947 to this lower section 11 of the edge guide 18.

To stop a curtain coating process the described measures have to be performed in reverse order. The controller activates the pivoting of the lower section 11 of the edge guides 18. The lower section 11 of edge guide 18 is displaced from its vertical position (FIG. 3) towards its raised position (FIG. 4). Within the same second the pneumatic system 23 pushes the curtain interceptor 13 in its intercepting position. The free falling curtain is gathered via the interceptor 13 in a catch tray 15. The operator can now take the necessary measures in order to stop or to restart the coating without the web 3 being contaminated.

It is to be understood that the present invention is not limited to the described embodiments hereinbefore. It is obvious that the interrupting of the edge guiding of the curtain can be obtained by using other embodiments. The displacement of at least a section of the edge guides can occur in any direction such as in a direction which is opposite to the direction of advance of the travelling web, and is not limited to a pivotal movement. A section of the edge guides or the entire edge guide can also slide or pivot about an axis that is not in a plane normal to the axis of the web supporting roller. The hinges of the edge guides can be connected at the hopper so that the entire edge guides are displaceble. The edge guides can be constructed for telescoping movement so that the displacement consist in a sliding of one section into another. The edge guide can also be constructed out of a elastic material that is flexed away by any means in order to let the curtain interceptor pass underneath. The ajusting of the edge guides need not only occur by pneumatic means, but hydraulic, electrical and other driving means can be used.

I claim:

1. In a method of curtain coating a moving web in which a web is moved along a fixed path and a generally planar curtain of a liquid coating composition is formed on a coating hopper and allowed to fall from said hopper by gravity and impinge on said moving web generally transversely of said path at a locus along said path while the web is supported on a web-supporting roller rotating on an axis generally transverse to said web path and while side edges of the curtain are acted upon by edge guides arranged on opposite sides of the web path between the hopper and web and extending at one end into proximity to said web for laterally guiding the curtain side edges and substantially preventing contraction of the transverse dimension of the falling curtain, and the coating is occasionally interrupted by intercepting the falling curtain before the same inpinges on the moving web by means of a curtain intercepting member in an intercepting position adjacent the web and then restored by displacing said curtain intercepting member from its intercepting position to an inoperative position out of the path of the curtain, the improvement which comprises intercepting with said curtain intercepting member the entire transverse dimension of the curtain between said edge guides while displacing independently of said coating hopper at least a portion of each edge guide which is adjacent to said web away from said web to a position removed from said web and clear of said intercepting member when said member is in its intercepting position, and when said intercepting member is displaced to its inoperative position returning each of said portions of the edge guides to its position adjacent said web.

2. The method of claim 1 which includes the step of providing an auxiliary liquid to the edges of said curtain to facilitate guiding of the curtain edges by said edge guides.

3. The coating method of claim 1 wherein each of said displaceable edge-guide portions are maintained in an edge-guiding position that is generally co-planar with the plane of the falling curtain and said edge-guiding portions are each displaced to a position removed from the corresponding curtain edge portion that is out of the plane of the falling curtain.

4. In a curtain coater for coating a moving web with at least one layer of a liquid coating composition, which apparatus comprises a web-supporting roller for conveying the moving web along a fixed path, said roller being rotatable about an axis generally transverse to said path, a coating hopper for forming said coating composition into a free-falling generally planar curtain which extends transversely of the web and terminates in opposite side edges, said curtain impinging the web at a locus along said path where the web is supported on said roller, edge guides arranged substantially at said locus on opposite sides of said path for laterally guiding the side edges of said curtain to substantially prevent contraction of the dimention of the curtain transverse to the web path while the curtain falls from the hopper to the web, said edge guides terminating at one end thereof in proximity to the web being coated, and a curtain intercepting member which is displaceable to and from an operative position adjacent the web for occasionally intercepting the curtain before the curtain impinges on the web from and to an inoperative position out of the way of the curtain to restore the curtain coating, in combination, the improvement wherein said curtain intercepting member has a dimension transverse of the web that is greater than the transverse distance between said edge guides and at least a portion of each edge guide adjacent the web is displaceable independently of said coating hopper away from and to an edge-guiding position adjacent the web to and from a position removed from the web and out of the way of the intercepting member when said member is in its operative position adjacent the web, whereby each said edge guide portion is displaced to its out of the away position when the intercepting member is displaced to its operative position and returned to its position adjacent the web when said intercepting member is displaced to its inoperative position.

5. A curtain coater according to claim 4 wherein the edge guides comprise an upper stationary section and a lower displaceable section.

6. A curtain coater according to claim 4 wherein each said displaceable portion of the edge guides is mounted for swinging movement about an axis generally parallel to said axis of the web-supporting roller.

7. A curtain coater according to claim 4 including means for reducing thick edge portions of the curtain associated with said edge guides.

8. A curtain coater of claim 4 wherein each said edge guide portion has a curtain edge-guiding position that is generally co-planar with the plane of the falling curtain and is displaceable from said generally parallel edge-guiding position to a position removed from the corresponding curtain edge portion that is out of the plane of the curtain.

9. The curtain coater of claim 4 including control means for controlling the displacement of said intercepting member and said edge-guide portions from and to their respective positions.

* * * * *

UNITED STATES PATENT AND TRADEMARK OFFICE

CERTIFICATE OF CORRECTION

PATENT NO. : 5,330,797
DATED : July 19, 1994
INVENTOR(S) : Willem Mues, et. al.

It is certified that error appears in the above-indentified patent and that said Letters Patent is hereby corrected as shown below:

Column 8, Claim 8, line 1, change "A" to --The--.

Signed and Sealed this

Thirtieth Day of August, 1994

*Attest:*

*Attesting Officer*

Bruce Lehman

BRUCE LEHMAN

*Commissioner of Patents and Trademarks*